US007175016B2

(12) United States Patent
Seagle et al.

(10) Patent No.: US 7,175,016 B2
(45) Date of Patent: Feb. 13, 2007

(54) SENSOR POSITION ADJUSTING DEVICE FOR A COIN DISPENSER

(75) Inventors: Donald Lee Seagle, Sandy Valley, NV (US); Stanley John Kopala, Las Vegas, NV (US)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 665 days.

(21) Appl. No.: 10/660,928

(22) Filed: Sep. 12, 2003

(65) Prior Publication Data

US 2005/0056520 A1 Mar. 17, 2005

(51) Int. Cl.
*G07F 5/02* (2006.01)

(52) U.S. Cl. ..... 194/239; 453/58

(58) Field of Classification Search ..... 194/239, 194/215, 224, 217–222, 230–232; 453/1, 453/2, 16, 17, 58

See application file for complete search history.

(56) References Cited

U.S. PATENT DOCUMENTS 4,437,478 A 3/1984 Abe
RE32,799 E 12/1988 Abe
5,516,293 A 5/1996 Heidel et al.
6,599,181 B2 7/2003 Abe et al.
2002/0013127 A1* 1/2002 Abe et al. ..... 453/18

FOREIGN PATENT DOCUMENTS

JP 09-259318 3/1997

* cited by examiner

*Primary Examiner*—Patrick Mackey
*Assistant Examiner*—Jeremy R Severson

(57) ABSTRACT

A device for accurately adjusting the position of a sensor unit relative to a driving member. The driving member is moved by a coin dispensed by a coin dispenser. The sensor unit is mounted on a movable base plate that is positioned on a fixed base plate attached to the coin dispenser. The relative position of the sensor unit to the driving member is adjusted by a screw unit that can adjust the position of the movable base plate relative to the fixed base plate. A fixing unit secures the movable base plate from moving relative to the fixed base plate once the desired sensor unit position is selected using the screw unit.

20 Claims, 6 Drawing Sheets

SENSOR POSITION ADJUSTING DEVICE FOR A COIN DISPENSER

FIELD OF THE INVENTION

The present invention is related to sensor position adjusting device and more particularly to a sensor position adjusting device for a coin dispenser that can be adjusted easily and precisely.

DESCRIPTION OF RELATED ART

A coin dispenser having a dispensing disk having a plurality of pins on the dispensing disk for dispensing coins one at a time, is known. The dispensed coins can move a lever arm in proximity to a sensor for detecting dispensed coins. However, the position of the sensor relative to the lever arm cannot be easily and precisely adjusted, and often can move out of the desired position as the sensor is secured.

U.S. Pat. No. 4,437,478 granted to Abe discloses a device where the dispensed coins or tokens contact a roller that moves an actuating arm to interact with a sensor. The actuating arm moves between a pair of spaced-apart sensor coils to define a slot for receiving one end of the actuating arm.

Japanese Patent No. 09-259318 granted to Takashi discloses a coin dispenser with a lever and an adjustable sensor. The position of the sensor can be adjusted relative to the lever by adjusting a screw, but the adjustment is performed by hand and can be imprecise. This imprecision may require multiple attempts to properly position the sensor relative to the lever.

Accordingly, there is still a demand in the prior art to provide a highly accurate and easy to use sensor positioning device.

SUMMARY OF THE INVENTION

The present invention addresses the limitations of the prior art by providing a sensor position adjusting device including a screw unit for accurately adjusting the position of the sensor unit relative to a driven member moved by a dispensed coin.

The sensor position adjusting device includes a rotatable coin selecting disc member for selectively dispensing coins, a driven member that is moved by the dispensed coins, a sensor unit for detecting the movement of the driven member, and a screw unit for accurately adjusting the position of the sensor unit relative to the driven member.

The position adjusting unit includes a fixed base plate attached to the coin dispenser and a movable base plate carrying the sensor unit. The movable base plate can move relative to the fixed base plate in order to adjust the position of the sensor unit relative to the driven member. A screw unit can adjust the position of the movable base plate relative to the fixed base plate by turning the screw in a predetermined direction.

The fixed base plate has a bracket extending perpendicular to the fixed base plate and the movable base plate has a bracket extending perpendicular to the movable base plate. The movable base plate is placed adjacent to the fixed base plate in such a way that the brackets are parallel. A screw is passed through a through hole in the fixed base plate bracket and threaded into the movable base plate bracket so that by turning the screw the position of the movable base plate can be adjusted relative to the fixed base plate.

Once the proper position of the sensor unit is determined, a fixing unit can secure the movable base plate against movement relative to the fixed base plate so the sensor unit can maintain the determined position. The fixing unit applies force in a direction that is perpendicular to the plane of adjustment so that by fixing the position of the movable base plate, the adjustment position of the sensor is not altered.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
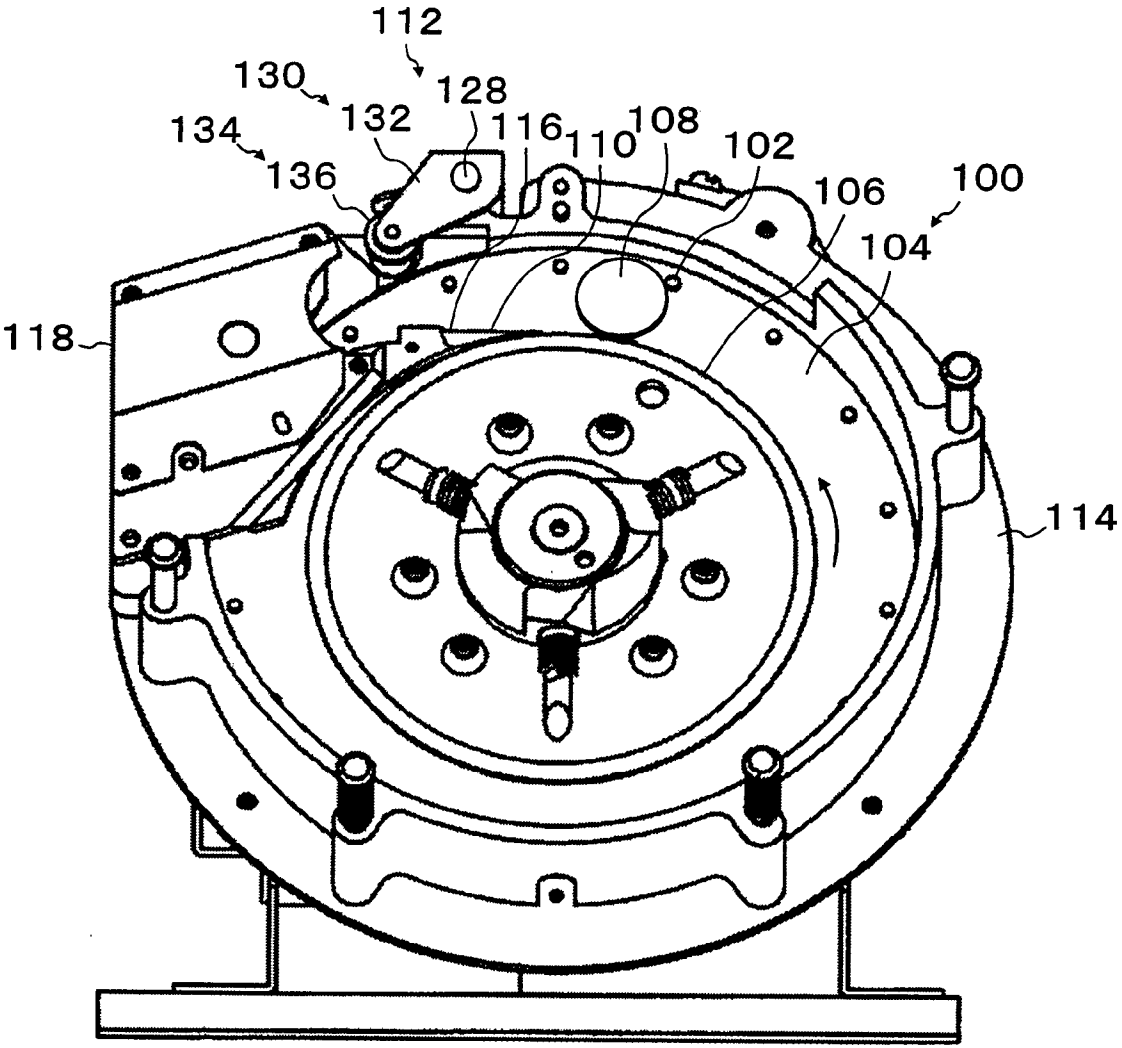
FIG. 1 shows a front view of the coin dispenser which is inclined at an angle with the horizontal where a coin is carried on the rotating disk but is not yet detected by the coin detecting unit. In this view, the coin bowl is detached from the coin dispenser while the sensor position adjusting unit is attached to the coin dispenser, in an embodiment of the present invention.

In reference to FIG. 1, a coin dispenser 100 includes a rotating coin selecting disk member 104 (a rotating disk 104), a circular raised section 106, a knife unit 110, and a coin detecting unit 112. The rotating disk 104 has a flat surface and includes pins 102 protruding from the flat surface, and which are located at a predetermined distance on the periphery of the disk member 104. The circular raised section 106 is centered axially on the rotating disk 104 and extends a predetermined distance from the surface of the rotating disk 104 in order to form a circular channel for supporting coins 108 on the flat surface of the rotating disk 104 between the pins 102.

In this specification, a coin can be a token, a medal or medallion, a disc or any similar thin article of a substantially circular shape that may be stored, manipulated, and dispensed as herein described.

The rotating disk 104 is supported by a base plate 114 and is inclined at an angle to the horizontal plane so that, when a coin bowl (not shown) containing coins 108 is attached to the coin dispenser 100, some coins 108 in the coin bowl will rest against a lower portion of the rotating disk 104. The pins 102 on the rotating disk 104 have contact with the coins 108 as the rotating disk 104 moves in a counter clockwise direction, as shown in FIG. 1.

During rotation of the rotating disk 104, the churning motion of the coins 108 causes a coin 108 to fall against the flat surface of the rotating disk 104 between adjacent pins 102 termed leading and lagging pins. The lagging pin in the direction of rotation pushes the coin 108 in the direction of rotation, and brings the coin 108 out from the quantity of coins in the coin bowl that are pressed against the rotating disk 104. The flat surface of the coin 108 is supported by the flat surface of the rotating disk 104, while an edge of the coin is supported by the raised section 106 as the rotating disk 104 is inclined at an angle to the horizontal plane.

The pin 102 pushes the coin 108 to the knife unit 110, as shown in FIG. 1. The knife unit 110 includes a narrow region starting at a point and widens in the direction of rotation of the rotating disk 104 to form a wedge like device. The point of the knife unit 110 is placed in proximity to the juncture between the rotating disk 104 and the raised section 106 at an upper portion of the inclined rotating disk 104 so that, as a coin 108 is rotated on the rotating disk 104, the coin will contact the knife unit 110 and be driven by the knife unit horizontal surface 116 to a position radially outwards from the center of the rotating disk 104 towards the coin detecting unit 112.

Figure 2:
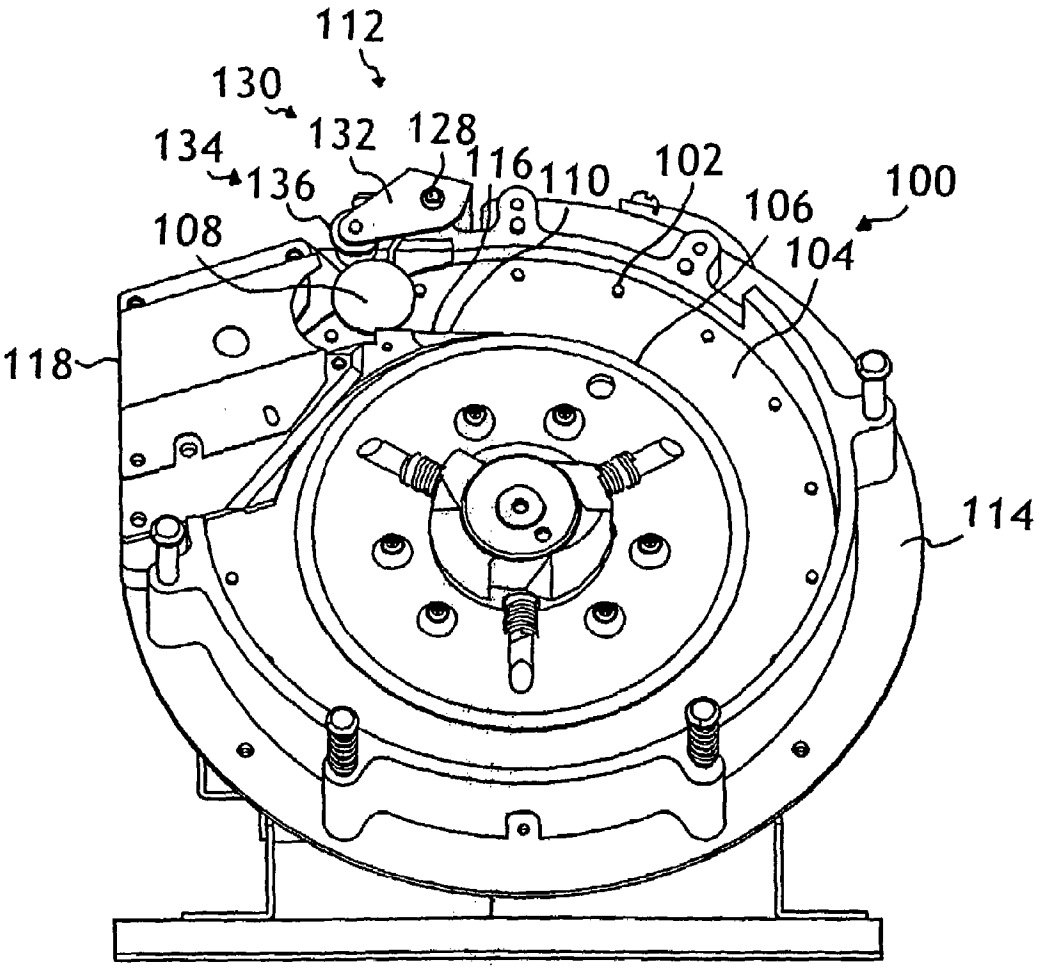
FIG. 2 shows a front view of the coin dispenser which is inclined at an angle with the horizontal where a coin is being detected by the coin detecting unit.

In reference to FIG. 2, as the coin 108 pushed by a pin 102 is driven radially outwards by the knife unit horizontal surface 116, the coin 108 contacts a contacting member 134 which is a roller 136 attached to a first lever 132. The coin 108 pushes against the roller 136 to rotate the first lever 132 in a clockwise direction about a shaft 128 to detect the coin 108. After being detected by the coin detecting unit 112, the coin 108 is guided to the dispensing outlet 118 and exits the coin dispenser 100. Only one coin 108 may be carried between two adjacent pins 102 on the surface of the rotating disk 104, but the rotating disk 104 may carry more than one coin 108 at a time.

Figure 3:
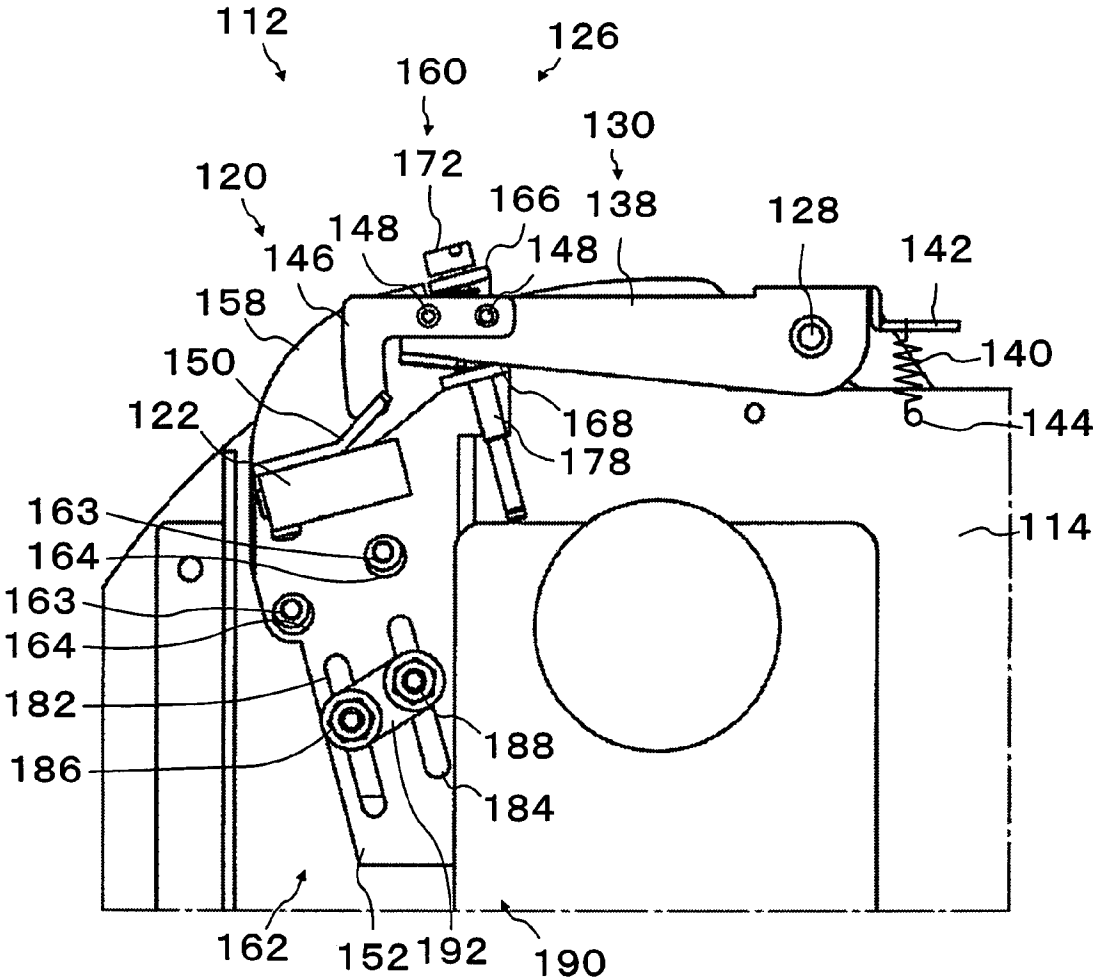
FIG. 3 is a partial rear view of the coin dispenser showing the sensor position adjusting unit attached to the coin dispenser in an embodiment of the present invention.

In reference to FIGS. 1–3, the first lever 132 on a first side of the rotating disk 104 is attached through a shaft 128 to a second lever 138 on the second side of the rotating disk 104. The shaft 128 is attached to the base plate 114 so that as the first lever 132 moves in an upwards direction, the second lever 138 moves in a downward direction, and vice versa. Lever 130 includes the first lever 132, the shaft 128, the second lever 138, and an arm 142 which extends parallel to the second lever 138 on an opposite side of the shaft 128. A spring 140 is attached between the arm 142 and the base plate 114 to bias the lever 130 with a clockwise rotation as shown in FIG. 3. As a coin 108 pushes against the roller 136, lever 130 moves in a counter clockwise direction as shown in FIG. 3.

Attached to lever 130 is a driven member 120. The driven member 120 includes an L-shaped operating member 146 that is detachably mounted to lever 130 by a pair of screws 148. The driven member 120 is moved by a coin 108 as the coin is dispensed by the coin dispenser 100. The coin detecting unit 112 includes a driven member 120, a sensor unit 122, and a sensor position adjusting unit 126. The sensor unit 122 detects movement of the driven member 120 attached to lever 130 while the position adjusting unit 126 adjusts the position of the sensor 122 to accurately detect the presence of the operating member 146 in proximity to the sensor unit 122, thereby detecting a dispensed coin 108. Preferably, the end of the operating member 146 is sensed by the sensor unit 122, but the exact position of the operating member 146 during sensing depends on the particular sensor unit 122.

As a coin 108 contacts the roller 136 to move the first lever 132 in an upwards direction, the second lever 138 moves in a counter clockwise direction, as shown in FIG. 3, and carries the operating member 146 into proximity with the sensor unit 122 to enter a detecting condition. As the coin 108 continues past the roller 136, the spring 140 moves the second lever in an upwards direction, rotating in a clockwise manner in FIG. 3, and returns to a non-detecting or idle condition.

The sensor unit 122 is attached to a bracket 150 which is mounted on a movable base plate 152. The sensor unit 122 has the function of detecting the presence of the operating member 146 in proximity to the sensor unit 122, and may be implemented using an optical emitter and sensor pair, a proximity sensor, a coil, a switch, an electromagnetic sensor, or any equivalent device that implements the sensing function as herein described.

Figure 4:
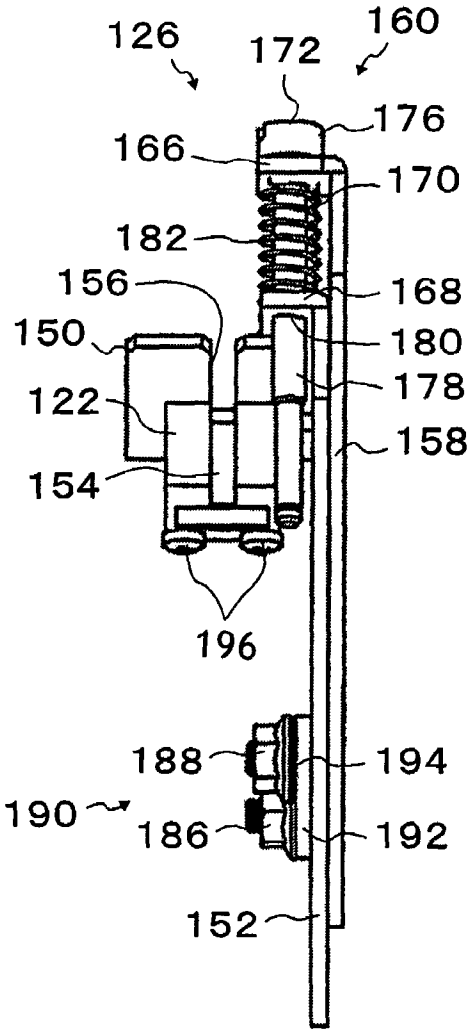
FIG. 4 is a side view of the sensor position adjusting unit in an embodiment of the present invention.
Figure 5:
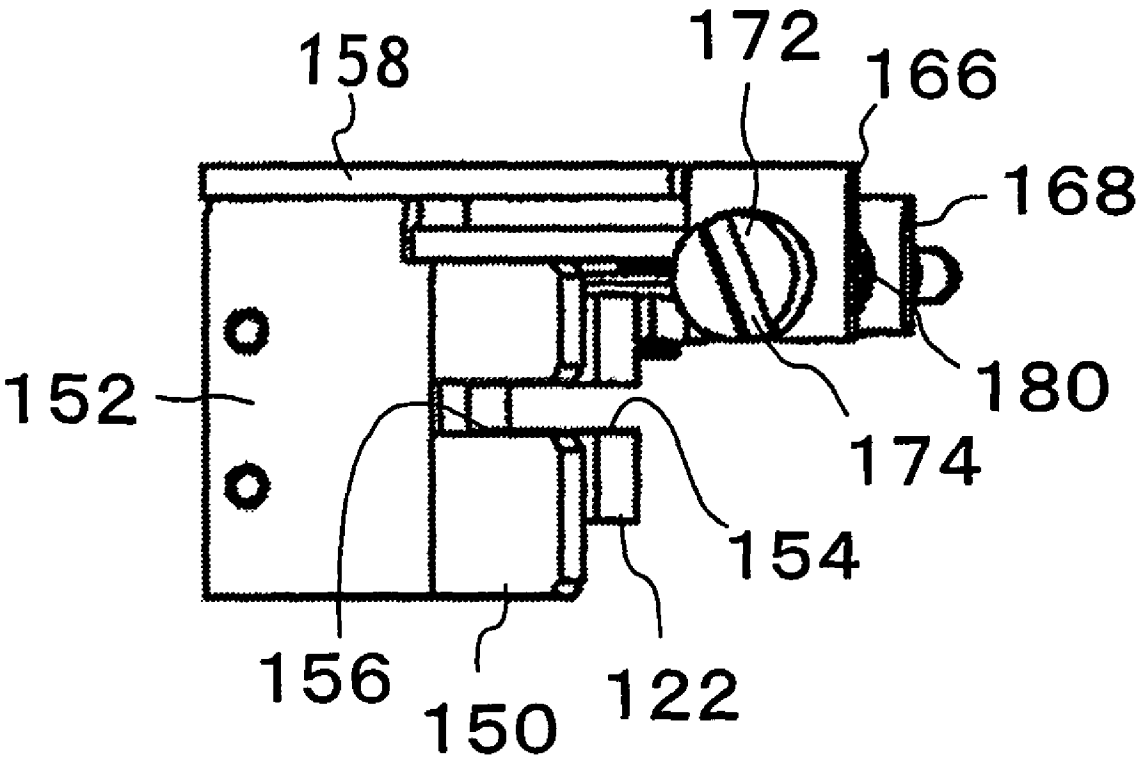
FIG. 5 is a top view of the sensor position adjusting unit in an embodiment of the present invention.

Sensor unit 122 is channel like in shape and has a slit 154 for admitting a portion of the operating member 146 as shown in FIGS. 4–5. The sensor unit 122 is mounted on the underside of bracket 150 by screws 196. The bracket 150 is formed by bending an upper portion of the movable base plate 152. Slit 156 is formed at the end of bracket 150 and is smaller than or equal to the width of slit 154 to protect the sensor unit 122 from damage caused by excess movement of the operating member 146 during detection.

In reference to FIG. 3, the position adjusting unit 126 can adjust the position of the sensor unit 122 relative to the operating member 146 which is an extension of the lever 130. The position adjusting unit 126 includes a fixed base plate 158, a movable base plate 152, a screw unit 160, and a guiding unit 162. The fixed base plate 158 is mounted on the base plate 114, and does not move relative to the base plate 114 while the movable base plate 152 can move relative to the fixed base plate 158. The bracket 150 is mounted on the movable base plate 152 to allow the movement of the sensor unit 122 relative to the position of the operating member 146 at the point of detection. The point of detection is the point of maximum rotation of the lever 130 caused by a coin 108 in the coin detecting unit 112 as shown in FIG. 2.

The screw unit 160 can adjust the relative position between the movable base plate 152 and the fixed base plate 158. The guiding unit 162 restricts the movement of the movable base plate 152 to a predetermined direction. In reference to FIG. 3, the fixed base plate 158 is attached to the base plate 114 by screws 163 applied through holes 164. Screws 163 have a flat head and fit into counter-sunk holes 164 so that the top surface of the screws 163 does not protrude beyond the surface of the fixed base plate 158 to interfere with the movement of the movable base plate 152.

The screw unit 160 can accurately move the movable base plate 152 relative to the fixed base plate 158. In reference to FIG. 4, the fixed plate 158 has a bent extension that forms a fixed bracket 166. The movable plate 152 has a bent extension that forms a movable bracket 168. The fixed bracket 166 and the movable bracket 168 are bent so they are parallel to each other.

The fixed bracket 166 has a through hole 170 while the movable bracket 168 has a threaded hole 180 for receiving a screw 172 drawn through in a direction from the through hole 170 to the threaded hole 180 by turning a driving groove 174 at the screw head 176 of the screw 172. The screw 172 has a threaded section 178 for engaging with the threaded hole 180 in the movable bracket 168.

The size of the through hole 170 is larger in diameter than the outer diameter of the threaded section 178 so the screw threads do not engage the fixed bracket 166. The base of the screw head 176 is larger than the through hole 170 to retain the fixed bracket as the screw 172 is threaded into the threaded hole 180. The threaded section 178 has a predetermined pitch or number of turns per unit length. The finer the pitch, the more accurately may the relative distance be adjusted between the fixed base plate 158 and the movable base plate 152.

A spring 182 is interposed between the fixed bracket 166 and the movable bracket 168 in a position over the threaded section 178 in order to apply an axial, opposing force between the fixed bracket 166 and the movable bracket 168. The relative distance between the fixed bracket 166 and the movable bracket 168 can be adjusted by turning the screw head 176 in a first direction to advance the screw 172, compressing the spring 182, and drawing the movable bracket 168 closer to the fixed bracket 166. Alternatively, the relative distance between the fixed bracket 166 and the movable bracket 168 can be adjusted by turning the screw head 176 in a second direction, lengthening the spring 182, and causing the movable bracket 168 to move farther away from the fixed bracket 166.

In reference to FIG. 3, the guiding unit 162 restricts the movement of the movable base plate 152 to a predetermined direction which is parallel with the fixed base plate 158. The screw unit 160 moves the movable bracket 168 relative to the fixed bracket 166 along the axis of the screw 172. The guiding unit 162 includes a pair of elongated holes (182, 184) in the movable base plate that extend parallel to the axis of the screw 172. A fixing unit 190 includes two fixing screws (186, 188), a retainer 192, and spring washers 194. The ends of the retainer 192 have holes that coincide with both of the elongated holes (182, 184).

Each fixing screw (186, 188) can be placed through a spring washer 194, then through a hole on each end of the retainer 192, then through an elongated hole (182, 184) in the movable base plate 158, and finally can be secured to the fixed base plate 158. The fixing screws (186, 188) of the fixing unit 190 are loosened to permit the screw unit 160 to accurately adjust the position of the sensor unit 122 by moving the movable base plate 152 relative to the fixed base plate 158 along the axis of the elongated holes (182, 184).

When the fixing screws (186, 188) are loosened, the screw head 176 may be turned in a predetermined direction to accurately adjust the position of the sensor unit 122. Once the proper position of the sensor unit 122 is determined, the fixing screws (186, 188) are tightened to press the spring washers 194 to the retainer 192, pressing the retainer 192 against the movable base plate 152, thereby fixing the position of the movable base plate 152 on the fixed base plate 158. In this way, the movable base plate 152 is secured against movement relative to the fixed base plate 158 and the determined position of the sensor unit 122 is preserved.

Advantageously, the torque of tightening of the fixing screws (186, 188) is not transmitted to the movable base plate 152. As a result, the movable base plate 152 carrying the sensor unit 122 may be more accurately positioned and secured. This greater accuracy in positioning the sensing unit 122 relative to the operating member 146 will avoid time consuming and costly re-adjustments. In this embodiment, some elements of the guiding unit 162 and the fixing unit 190 are shared to reduce cost, but the guiding unit 162 and the fixing unit 190 may also be independent.

Figure 6:
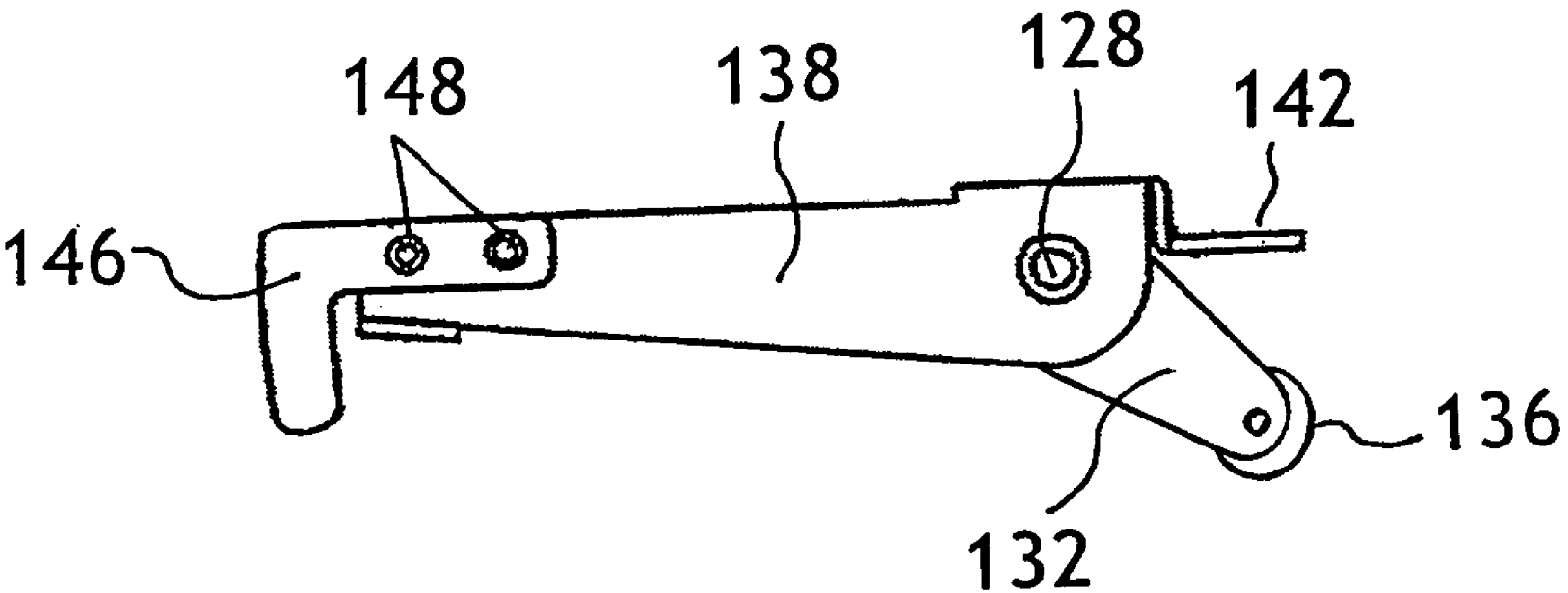
FIG. 6 shows a side view of the pivoting lever for use with the sensor unit to detect a dispensed coin.

As a review, when a coin 108 is being dispensed, the coin 108 encounters the roller 136 causing the roller 136 to move in an upwards direction as shown in FIG. 2. The movement of roller 136 in the upwards direction causes the first lever 132 to rotate in a clockwise direction around shaft 128. As shown in FIG. 6, the lever 130 includes the first lever 132 that is attached through shaft 128 to the second lever 138.

The movement of the first lever 132 in a clockwise direction to an active position is driven by a dispensing coin 108, as shown in FIG. 2 corresponds to the second lever 138 moving in a counter clockwise direction as shown in FIG. 3 so that the operating member 146 moves in proximity to the sensing unit 122, and the dispensed coin 108 is sensed. As the sensed coin 108 continues moving toward the dispensing outlet 118, the movement of the first lever 132 in a counter clockwise direction to an idle position is driven by spring 140 attached between a pin 144 on the base plate 114 and the arm 142 on the lever 130. After a dispensed coin 108 is sensed, the lever 130 returns to an idle position. The lever 130 pivots about the shaft 128 that is fixed in the base plate 114.

If the diameter of the coin 108 is changed, either larger or smaller, the position of the sensing unit 122 and the operating member 146 can be adjusted. To adjust the position of the sensing unit 122, the fixing screws (186, 188) are loosened thereby allowing the movable base plate 152 to move relative to the fixed base plate 158 under the control of the screw unit 160. The screw head 176 can be turned by a screwdriver (not shown) to cause the movable bracket 168 to move closer to, or farther from, the fixed bracket 166 thereby adjusting the position of the sensor unit 122 relative to the end of the operating member 146.

The spring 182 provides an axial force along the screw 172 that pushes the movable bracket 168 away from the fixed bracket 166, thereby allowing the screw 172 to adjust the relative position of the sensing unit 122 in either direction, towards or away from the operating member 146. The amount of movement along the axis of the screw 172 for each turn of the screw head 176 depends on the pitch of the screw 172 defined by the number of turns per unit length.

A screw 172 with a finer pitch, defined by more turns per unit length, would require more turns of the screw head 176 to effect a predetermined amount of movement. Conversely, a screw 172 with a coarser pitch, defined by fewer turns per unit length, would require fewer turns of the screw head 176 to effect the same predetermined amount of movement.

Once the new position of the sensor unit 122 is determined for a coin 108 of a new diameter, the fixing screws (186, 188) can be tightened to push the spring washers 194 against the retainer 192 which pushes the movable base plate 152 against the fixed base plate 158, thereby securing the movable base plate 152 in a fixed position relative to the fixed base plate 158.

The driving member 120 defines a plane of motion when moved by a dispensed coin 108. This plane of motion is parallel to the base plate 114 since the shaft 128 is mounted perpendicular to the base plate 114 as shown in FIGS. 1–3.

The screw unit adjusts the relative position of the sensor unit 122 and the driving member 120 in a plane parallel to the plane of motion defined by the movement of the driving member, and the relative position of the sensor unit 122 is adjusted in alignment with the guiding unit 160.

The fixing unit 190 secures the movable base plate 152 against movement relative to the fixed base plate 158 by fastening the movable base plate 152 to the fixed base plate 158 with a force applied perpendicular to the plane of the base plate 114. This allows the sensor unit 122 to be adjusted and fixed in position more accurately since the torque of the fixing screws (186, 188) is not transmitted in the direction of the adjustment.

Although in the preferred embodiment the sensor unit 122 detects the position of the end of the operating member 146 in proximity to the sensor, the actual position of the operating member 146 at the point of detection may change depending on the particular sensor unit 122. Various technologies may be employed for the sensor unit 122 as well as manufacturing variances that may affect the exact position of the operating member relative to the sensor unit 122.

As shown in FIG. 6, the operating member 146 may preferably be composed of metal. However, other materials may be used such as plastic, or other non-conductive materials and may depend on the technology used in the sensor unit 122. Also, the operating member 146 can be attached to the second lever 138 using screws 148 for a removable attachment, or can be attached using rivets.

The descriptions of various orientations of elements, positions, and movements herein by using words such as up, down, left, right, clockwise rotation, and counter clockwise rotation are for convenience, and are not to be considered as limiting.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A sensor position adjusting device, comprising:

a driving member for being driven by a coin dispensed by a coin dispenser;

a sensor unit for detecting movement of the driving member to detect a coin dispensed by a coin dispenser; and a screw unit for adjusting the relative position of the sensor unit and the driving member including a fixed base plate attached to the coin dispenser, the fixed base plate having a first bracket extending perpendicular to the fixed base plate, a movable base plate releasably attached to the fixed base plate, the movable base plate having a second bracket extending perpendicular to the movable base plate, the sensor unit being mounted on the movable base plate, wherein the movable base plate includes elongated holes along the axis of a screw, the elongated holes allowing movement of the movable base plate relative to the fixed base plate only in the direction of the elongated holes, and the screw positioned to operatively connect a portion of the first bracket and the second bracket so that turning the screw causes the first bracket and the second bracket to move relative to each other, wherein turning the screw adjusts the position of the sensor unit.

2. The sensor position adjusting device of claim 1, further comprising:

a fixing unit for preserving the relative position of the movable base plate to the fixed base plate.

3. The sensor position adjusting device of claim 2, wherein the fixing unit includes a fixing screw threaded from the movable bracket to the fixed bracket such that tightening the fixing screw does not change the position of the movable bracket to the fixed bracket.

4. The sensor position adjusting device of claim 2, further comprising:

a spring mounted over an axis of the screw and between the first bracket and the second bracket, the spring providing an opposing force between the first bracket and the second bracket along the axis of the screw.

5. The sensor position adjusting device of claim 1, wherein the first bracket has a through hole and the second bracket has a threaded hole, the screw being positioned to pass through the through hole and being threadedly engaged in the threaded hole, the through hole having a diameter that is larger than the diameter of the screw so that the screw is retained in the through hole in a non-threaded manner.

6. The sensor position adjusting device of claim 1, wherein the sensor unit includes an optical emitter and sensor pair.

7. The sensor position adjusting device of claim 1, wherein the sensor unit includes a proximity sensor.

8. The sensor position adjusting device of claim 1, wherein the sensor unit includes a switch.

9. The sensor position adjusting device of claim 1, wherein the sensor unit includes a coil.

10. The sensor position adjusting device of claim 1, wherein the sensor unit includes an electromagnetic sensor.

11. A sensor position adjusting device, comprising:

a driving member for being driven by a coin dispensed by a coin dispenser;

a sensor unit for detecting movement of the driving member to detect a coin dispensed by a coin dispenser; and a screw unit for adjusting the relative position of the sensor unit and the driving member includes a fixed base plate attached to the coin dispenser, the fixed base plate having a first bracket extending perpendicular to the fixed base plate, a movable base plate releasably attached to the fixed base plate, the movable base plate having a second bracket extending perpendicular to the movable base plate, the sensor unit being mounted on the movable base plate, and a screw positioned to operatively connect a portion of the first bracket and the second bracket so that turning the screw causes the first bracket and the second bracket to move relative to each other, wherein turning the screw adjusts the position of the sensor unit; and a fixing unit for preserving the relative position of the movable base plate to the fixed base plate including a fixing screw threaded from the movable bracket to the fixed bracket such that tightening the fixing screw does not change the position of the movable bracket to the fixed bracket.

12. The sensor position adjusting device of claim 11, wherein the movable base plate includes elongated holes along the axis of the screw, the elongated holes allowing movement of the movable base plate relative to the fixed base plate only in the direction of the elongated holes.

13. The sensor position adjusting device of claim 11, wherein the sensor unit includes an optical emitter and sensor pair.

14. The sensor position adjusting device of claim 11, wherein the sensor unit includes a proximity sensor.

15. The sensor position adjusting device of claim 11, wherein the sensor unit includes a switch.

16. A sensor position adjusting device, comprising:

a driving member for being driven by a coin dispensed by a coin dispenser;

a sensor unit for detecting movement of the driving member to detect a coin dispensed by a coin dispenser; and a screw unit for adjusting the relative position of the sensor unit and the driving member includes a fixed base plate attached to the coin dispenser, the fixed base plate having a first bracket extending perpendicular to the fixed base plate, a movable base plate releasably attached to the fixed base plate, the movable base plate having a second bracket extending perpendicular to the movable base plate, the sensor unit being mounted on the movable base plate, and a screw positioned to operatively connect a portion of the first bracket and the second bracket so that turning the screw causes the first bracket and the second bracket to move relative to each other, wherein turning the screw adjusts the position of the sensor unit, wherein the first bracket has a through hole and the second bracket has a threaded hole, the screw being positioned to pass through the through hole and being threadedly engaged in the threaded hole, the through hole having a diameter that is larger than the diameter of the screw so that the screw is retained in the through hole in a non-threaded manner.

17. The sensor position adjusting device of claim 16, further comprising:

a spring mounted over an axis of the screw and between the first bracket and the second bracket, the spring providing an opposing force between the first bracket and the second bracket along the axis of the screw.

18. A sensor position adjusting device, comprising:

a driving member for being driven by a coin dispensed by a coin dispenser;

a sensor unit for detecting movement of the driving member to detect a coin dispensed by a coin dispenser; and a screw unit for adjusting the relative position of the sensor unit and the driving member including a fixed base plate attached to the coin dispenser, the fixed base plate having a first bracket extending perpendicular to the fixed base plate, a movable base plate releasably attached to the fixed base plate, the movable base plate having a second bracket extending perpendicular to the movable base plate, the sensor unit being mounted on the movable base plate, a screw positioned to operatively connect a portion of the first bracket and the second bracket so that turning the screw causes the first bracket and the second bracket to move relative to each other, wherein turning the screw adjusts the position of the sensor unit, a spring mounted over an axis of the screw and between the first bracket and the second bracket, the spring providing an opposing force between the first bracket and the second bracket along the axis of the screw; and a fixing unit for preserving the relative position of the movable base plate to the fixed base plate.

19. The sensor position adjusting device of claim 18, wherein the first bracket has a through hole and the second bracket has a threaded hole, the screw being positioned to pass through the through hole and being threadedly engaged in the threaded hole, the through hole having a diameter that is larger than the diameter of the screw so that the screw is retained in the through hole in a non-threaded manner.

20. The sensor position adjusting device of claim 18, wherein the fixing unit includes a fixing screw threaded from the movable bracket to the fixed bracket such that tightening the fixing screw does not change the position of the movable bracket to the fixed bracket.

* * * * *